US009312585B2

(12) United States Patent
Mochizuki

(10) Patent No.: US 9,312,585 B2
(45) Date of Patent: Apr. 12, 2016

(54) ISOLATION CIRCUIT, SYSTEM FOR ADJUSTING CHARACTERISTIC OF ISOLATION CIRCUIT, SHEILDING DEVICE OF ISOLATION CIRCUIT AND METHOD FOR ADJUSTING CHARACTERISTIC OF ISOLATION CIRCUIT

(71) Applicant: YOKOGAWA ELECTRIC CORPORATION, Musashino-shi, Tokyo (JP)

(72) Inventor: Satoshi Mochizuki, Musashino (JP)

(73) Assignee: Yokogawa Electric Corporation, Tokyo (JP)

( * ) Notice: Subject to any disclaimer, the term of this patent is extended or adjusted under 35 U.S.C. 154(b) by 0 days.

(21) Appl. No.: 14/404,806

(22) PCT Filed: May 24, 2013

(86) PCT No.: PCT/JP2013/064526

§ 371 (c)(1),
(2) Date: Dec. 1, 2014

(87) PCT Pub. No.: WO2013/187214

PCT Pub. Date: Dec. 19, 2013

(65) Prior Publication Data

US 2015/0171497 A1 Jun. 18, 2015

(30) Foreign Application Priority Data

Jun. 12, 2012 (JP) ..... 2012-132443

(51) Int. Cl.
*H01P 1/10* (2006.01)
*H01P 5/10* (2006.01)
*H01P 1/20* (2006.01)

(52) U.S. Cl.
CPC ..... *H01P 1/10* (2013.01); *H01P 1/2005* (2013.01); *H01P 5/10* (2013.01)

(58) Field of Classification Search
CPC ..... H01P 1/10; H01P 1/20; H01P 5/10
USPC ..... 333/24 R, 25, 26
See application file for complete search history.

(56) References Cited

U.S. PATENT DOCUMENTS 5,965,494 A 10/1999 Terashima et al.
8,174,341 B2 * 5/2012 Lee ..... H01P 7/082 333/219

(Continued)

FOREIGN PATENT DOCUMENTS

CN 102197533 A 9/2011
JP 09-307307 A 11/1997

(Continued)

OTHER PUBLICATIONS

Search Report dated Aug. 20, 2013, issued by the International Searching Authority in counterpart International Application No. PCT/JP2013/064526.

(Continued)

*Primary Examiner* — Dean Takaoka
*Assistant Examiner* — Alan Wong
(74) *Attorney, Agent, or Firm* — Sughrue Mion, PLLC

(57) ABSTRACT

The purpose is to adjust a characteristic of the isolation circuit with a simple control. An isolation circuit 1 of the invention includes a cell region 20 including a plurality of arrayed cells 21, each of which has a first conductor 22 that has at least one capacitance C1, C2, a second conductor 23 that is connected to the first conductor 22, has an inductance, and is short-circuited to a common electric potential, and a feed line 24 that is placed without a connection with the first conductor 22 and the second conductor 23, each size of which is smaller than a wavelength λ of a signal which is subject to operation of the cells 21; at least one power amount controller 25 that controls an amount of electric power to be fed to each of the feed lines 24 of the respective cells 21 of the cell region 20, thereby controlling either or both a dielectric constant and/or magnetic permeability of the cell region 20; and a circuit section 5 that is placed at a location where the circuit section undergoes action of either or both the dielectric constant and/or the magnetic permeability and that electrically isolates an input side from an output side.

10 Claims, 9 Drawing Sheets

(56) References Cited

U.S. PATENT DOCUMENTS

| | | | | |
|---|---|---|---|---|
| 8,575,731 | B2 * | 11/2013 | Ujita | H01L 23/64 257/379 |
| 8,674,792 | B2 * | 3/2014 | Yonak | H01P 1/20381 333/205 |
| 8,830,556 | B2 * | 9/2014 | Smith | B82Y 20/00 250/505.1 |
| 8,989,750 | B2 * | 3/2015 | Mochizuki | H01Q 15/02 455/446 |
| 2009/0174609 | A1 | 7/2009 | Sanada | |
| 2010/0019861 | A1 | 1/2010 | Ryou et al. | |
| 2011/0163826 | A1 | 7/2011 | Toujo | |
| 2011/0175672 | A1 | 7/2011 | Nguyen et al. | |
| 2012/0287000 | A1 * | 11/2012 | Ando | H01Q 21/08 343/700 MS |
| 2013/0069848 | A1 | 3/2013 | Toyao et al. | |

FOREIGN PATENT DOCUMENTS

| | | | |
|---|---|---|---|
| JP | H 9 307307 | A | 11/1997 |
| JP | 2008-118816 | A | 5/2008 |
| JP | 2010-517462 | A | 5/2010 |
| JP | 2012-146945 | A | 8/2012 |
| WO | 02089256 | A1 | 11/2002 |
| WO | 2010/100801 | A1 | 9/2010 |
| WO | 2011/152055 | A1 | 12/2011 |

OTHER PUBLICATIONS

Written Opinion dated Aug. 20, 2013, issued by the International Searching Authority in counterpart International Application No. PCT/JP2013/064526.

Search Report dated Jan. 4, 2016, issued by the European Patent Office in counterpart European Application No. 13804647.9.

* cited by examiner

ISOLATION CIRCUIT, SYSTEM FOR ADJUSTING CHARACTERISTIC OF ISOLATION CIRCUIT, SHEILDING DEVICE OF ISOLATION CIRCUIT AND METHOD FOR ADJUSTING CHARACTERISTIC OF ISOLATION CIRCUIT

TECHNICAL FIELD

The invention relates to an isolation circuit that electrically isolates an input side and an output side from each other, a system for adjusting a characteristic of the isolation circuit, a shielding device of the isolation circuit, and a method for adjusting the characteristic of the isolation circuit.

BACKGROUND ART

An isolation circuit is used for electrically isolating an input side and an output side from each other. A transformer has primarily been known as an isolation circuit. Patent Document 1 discloses a technique pertinent to an isolation circuit using a piezoelectric transformer. FIG. 9 shows an example of a circuit that is an equivalent of circuitry using a transformer as an isolation circuit. The equivalent circuit has an input circuit 101, a transformer 102, and an output circuit 103. The input circuit 101 is circuitry for receiving a signal, and the output circuit 103 is circuitry for outputting a signal. The transformer 102 is also circuitry that effects electrical isolation.

The input circuit 101 has an AC power source 104 and input impedance 105, and the AC power source 104 is connected to a signal ground SG. A signal from the input circuit 101 is input to a first input port 106 of the transformer 102. A signal is output from a first output port 107 by action of electromagnetic coupling of the transformer 102. The signal is input to the output circuit 103. The output circuit 103 has a terminating resistor 108 and an ammeter 109. Accordingly, a signal is output from the output circuit 103.

In FIG. 9, in order to realize isolation in terms of the direct current, a signal ground SG is connected to a second input port 110 of the transformer 102, and a frame ground FG is connected to a second output port 111 of the transformer 102. Further, a capacitor 112 shown in FIG. 9 shows stray capacitance.

RELATED ART DOCUMENT

Patent Document

[Patent Document 1] JP-A-2008-118816

DISCLOSURE OF THE INVENTION

Problems that the Invention is to Solve

A circuit configuration using an isolation circuit is generally embodied like a configuration such as that shown in FIG. 9. The isolation circuit is manufactured by a physical circuit design, and a function of the isolation circuit is uniquely determined. The isolation circuit transmits a signal from a primary side (an input side) to a secondary side (an output side) while effecting electrical isolation. Accordingly, a frequency of an available signal depends on the design of the isolation circuit, and a frequency band of the signal also falls within a predetermined range. For instance, when an isolation circuit compatible with a 1 GHz band is designed, a 2 GHz band signal cannot be used by use of the isolation circuit.

Accordingly, in order to transmit a 2 GHz band signal by use of the isolation circuit, the isolation circuit itself needs to be replaced. Since an isolation circuit to be used is changed to another circuit at this time, replacing a board or making modifications to a circuit pattern is also necessitated. Consequently, extensive modifications are required to be made to entire circuitry formed on the board.

A frequency of a signal that is available in a manufactured isolation circuit is therefore restricted. This applies not only to a signal frequency but also to a signal phase. To be specific, a phase characteristic is uniquely determined in accordance with a manufactured isolation circuit. If a different phase characteristic is given to an isolation circuit, replacement of the isolation circuit is required after all, which necessitates extensive modifications to entire circuitry.

The isolation circuit also possesses a characteristic fixed by a circuit design. Accordingly, a mismatch occurs in input impedance of a signal that experiences action of the isolation circuit. In particular, a great mismatch occurs at either end of a frequency band at which the isolation circuit is to operate. A signal loss is also fixed by the circuit design of the isolation circuit, and a great signal loss might occur.

As mentioned previously, a circuit design of the isolation circuit is performed according to a frequency, or the like, of a signal employed. The lower the frequency of an employed signal, the greater an area of a mount board on which the isolation circuit is to be mounted. Further, variations occur in characteristic impedance for reasons of specific inductive capacity of a board, multilayered prepreg, a board thickness, and an over/under-edge caused by an etching method.

Accordingly, a function of an isolation circuit is uniquely determined, and an available signal is also determined by a characteristic of an isolation circuit. Specifically, the characteristic of the isolation circuit is fixed by the circuit design. If a signal unsuited to a characteristic of an isolation circuit is used, the signal will not pass through the isolation circuit, or the signal will be significantly deteriorated. For these reasons, when such a signal is used, replacement of the isolation circuit is required.

An object of the present invention is to adjust a characteristic of the isolation circuit with a simple control.

Means for Solving the Problems

In order to solve the problem, an isolation circuit of the invention comprises:

a cell region including a plurality of arrayed cells, each of which has a first conductor that has at least one capacitance, a second conductor that is connected to the first conductor, has an inductance, and is short-circuited to a common electric potential, and a feed line that is placed without a connection with the first conductor and the second conductor, each size of which is smaller than a wavelength of a signal which is subject to operation of the cells;

at least one power amount controller that controls an amount of electric power to be fed to each of the feed lines of the respective cells of the cell region, thereby controlling either or both a dielectric constant and/or magnetic permeability of the cell region; and a circuit section that is placed at a location where the circuit section undergoes action of either or both the dielectric constant and/or the magnetic permeability and that electrically isolates an input side from an output side.

According to the invention, a dielectric constant and magnetic permeability of the cell region and a dielectric constant and magnetic permeability of its neighboring space can be controlled by changing the amount of electric power to be fed to a feed line. Changes in dielectric constant and magnetic permeability affect the circuit section, so that the characteristic of the circuit section can be controlled. Accordingly, a necessity for newly designing an isolation circuit is obviated, and an isolation circuit having an arbitrary characteristic can be obtained.

The power amount controller may change a characteristic of the circuit section by changing the amount of electric power to be fed.

A dielectric constant and magnetic permeability vary as a result of the amount of electric power to be fed being changed. Changes in dielectric constant and magnetic permeability affect the circuit section, so that the characteristic of the circuit section is changed. The characteristic of the isolation circuit can be changed by changing the amount of electric power to be fed to an arbitrary value.

The amount of electric power to be fed may be previously set in the power amount controller such that the circuit section assumes a desirable characteristic.

The amount of electric power to be fed can be previously set in accordance with the characteristic of the circuit section. Therefore, the isolation circuit in accordance with the characteristic can be used. The amount of electric power to be fed that is previously set can be arbitrarily set.

The cell region may be divided into a plurality of areas, and the power amount controller controls the amount of electric power to be fed for each of the areas.

A cell region is divided into a plurality of areas, and an amount of electric power to be fed to each of the areas is controlled, whereby a dielectric constant and magnetic permeability can be changed on a per-area basis. A circuit section has a predetermined region, and a characteristic can be changed for each region of the circuit section.

The first conductor may have a substantially figure-eight shape including at least a cut formed in the substantially figure-eight shape.

The first conductor can have the capacitance by shaping the first conductor into a substantially figure-eight shape including at least a cut formed therein.

The isolation circuit may further comprise:

a circuit layer on which the circuit section is placed;

a cell region layer on which the cell region is placed; and a shielding layer which is provided at a layer differing from the circuit layer and the cell region layer and reflects external noise, the shielding layer having the cell region and the power amount controller.

The isolation circuit is implemented with a multilayer structure and given a shielding layer. By means of an effect of the shielding layer, external noise can be blocked, so that purity of a signal which passes through the isolation circuit can be assured. Especially, a sandwich structure is formed by placing a shielding layer on top and bottom of the circuit layer and the cell region layer, whereby external noise can be blocked to a much greater extent.

A characteristic adjustment system of an isolation circuit of the invention comprises:

the isolation circuit;

a signal detector that detects a signal output from the isolation circuit; and a power amount calculator that calculates, from a detection result of the signal detector, a value of the amount of electric power to be fed that provides the isolation circuit with a desirable characteristic in order to provide the power amount controller with the value of the amount of electric power to be fed.

The signal detector detects a signal, and the amount of electric power to be fed is calculated from a detection result and adjusted, whereby an isolation circuit having a desirable characteristic can be obtained.

A shielding device of an isolation circuit of the invention comprises:

the isolation circuit;

a first shield that is placed outside the isolation circuit, that has a the cell region and the power amount controller of the isolation circuit, and that reflects external noise; and a second shield that is placed outside the isolation circuit, that has the cell region and the power amount controller of the isolation circuit, and that reflects the noise, wherein the isolation circuit is sandwiched between the first shield and the second shield.

A first shield is placed above the isolation circuit, and a second shield is placed below the same, whereby external noise can be reflected, and the purity of the signal that passes through the isolation circuit can be assured.

A single chip of the invention is formed by packaging the isolation circuit, the characteristic adjustment system of an isolation circuit, or the shielding device of an isolation circuit.

Each of the foregoing circuits can be integrated into a single chip, whereby a size of the isolation circuit can be made compact.

A method for adjusting a characteristic of an isolation circuit of the invention comprises:

detecting a signal output from the isolation circuit;

calculating, from a result of the detected signal, a value of the amount of electric power to be fed that provides the isolation circuit with a desirable characteristic in order to provide the power amount controller of the isolation circuit with the value of the amount of electric power to be fed; and feeding an electric power of the calculated value to the feed line of the isolation circuit with use of the power amount controller.

Advantage of the Invention

According to the invention, a dielectric constant and magnetic permeability of the cell region and a dielectric constant and magnetic permeability of its neighboring space vary as a result of the amount of electric power to be fed to a feed line being changed. Changes in dielectric constant and magnetic permeability affect the circuit section, so that the characteristic of the circuit section is changed. Accordingly, a necessity for newly designing an isolation circuit is obviated, and an isolation circuit having an arbitrary characteristic can be obtained by changing the amount of electric power to be fed.

DETAILED DESCRIPTION

Figures 1A, 1B:
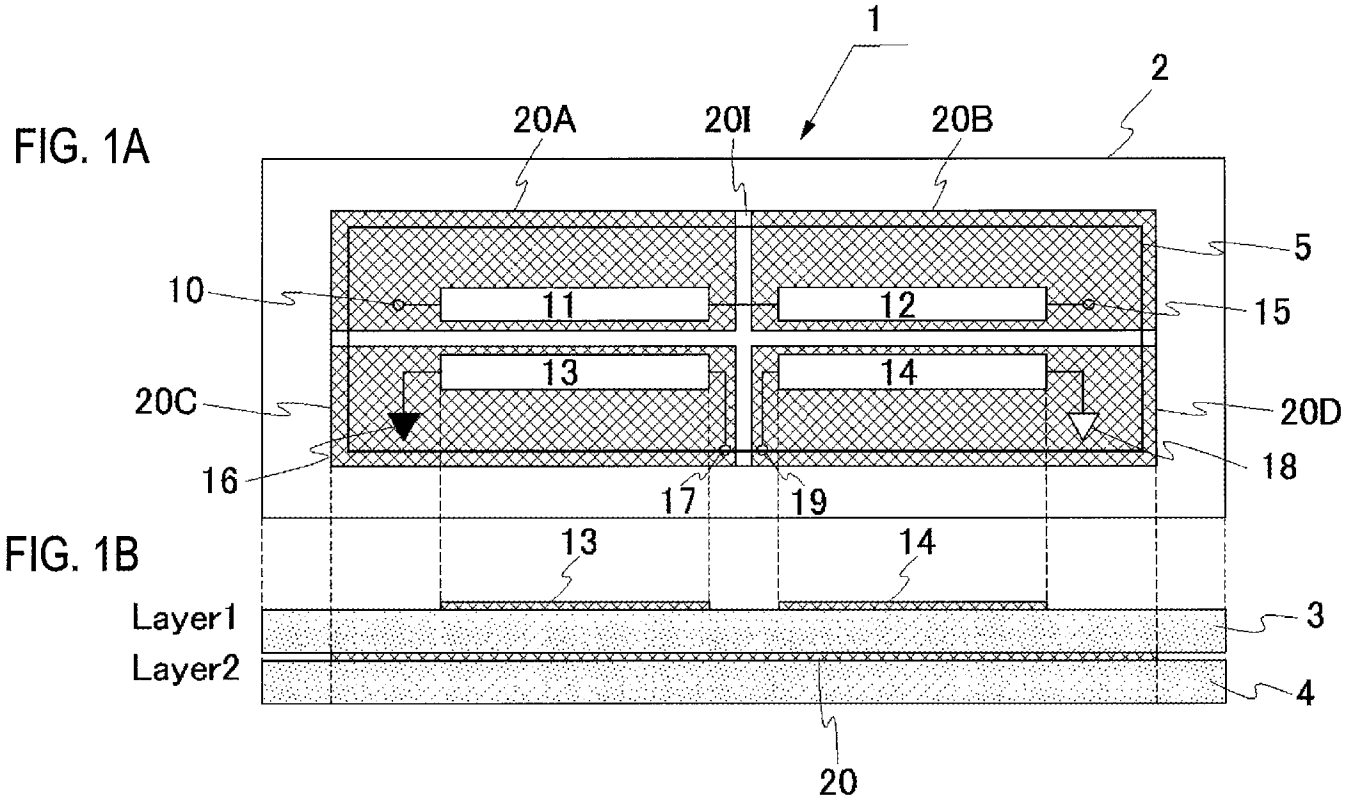
FIGS. 1A and 1B are a top view and a side view, respectively, of an isolation circuit according to an embodiment of the invention.

An embodiment of the invention is hereunder described. FIGS. 1A and 1B show an isolation circuit 1 of the embodiment. The isolation circuit 1 electrically isolates an input side from an output side. The isolation circuit 1 is made up of a layered body 2 with a multilayer structure. The isolation circuit 1 shown in FIG. 1 has a two-layer structure; namely, a first layer (Layer 1) and a second layer (Layer 2). A first layer board 3 is laid in the first layer 1, and a second layer board 4 is laid in the second layer. FIG. 1A provides a top view of the isolation circuit 1, and FIG. 1B provides a side view of the same.

First, the first layer is now described. The first layer is a circuit layer on which a circuit section 5 is fabricated. The circuit section 5 is fabricated on the first layer board 3 and configured as circuitry for electrically isolating an input side from an output side. Although a so-called Merchand balun is used as the circuit section 5, arbitrary circuitry can be applied to the circuit section 5, so long as the circuitry is an isolation circuit. For this reason, the circuit section 5 has an input port 10, a first line 11, a second line 12, a third line 13, a fourth line 14, an open end 15, a frame ground 16, a first output port 17, a signal ground 18, and a second output port 19.

Although the first line 11 and the second line 12 are connected together, the first line 11 and the second line 12, the third line 13, and the fourth line 14 are spaced apart from each other in a noncontact manner. The circuit section 5 thereby makes up an isolation circuit. It is desirable that the first line 11 and the third line 13 be parallel to each other and that the second line 12 and the fourth line 14 be parallel to each other.

The input port 10 is connected to one end of the first line 11, and the second line 12 is connected to the other end of the first line 11. The first line 11 is connected to one end of the second line 12, and the open end 15 is connected to the other end of the second line 12. The frame ground 16 is connected to one end of the third line 13, and the first output port 17 is connected to the other end of the third line 13. The signal ground 18 is connected to one end of the fourth line 14, and the second output port 19 is connected to the other end of the fourth line 14. The frame ground 16 is connected to the third line 13, and the signal ground 18 is connected to the fourth line 14, so that the circuit section 5 is completely isolated in terms of a direct current.

Next, the second layer (Layer 2) is described. The second layer board 4 is a cell region layer on which a cell region 20 is fabricated. Although the second layer is laid in a lower portion of the first layer, the second layer can also be laid in an upper portion of the first layer. Alternatively, the second layer can also be in the same layer where the first layer is laid. As shown in FIG. 1, the cell region 20 is divided into four regions, or four cell regions 20A, 20B, 20C, and 20D. The first line 11 to the fourth line 14 are laid in correspondence to the four cell regions 20A to 20D, respectively. For the sake of explanation, illustration of the first layer board 3 is omitted in the top view of FIG. 1(*a*).

The cell regions 20A to 20D are fabricated in a cross form while being partitioned from each other by means of an isolation 20I. Consequently, the cell regions 20A to 20D are electrically isolated from each other. Although the cell regions are partitioned in a cross shape in FIG. 1, the cell regions can also be partitioned by an arbitrary technique. Alternatively, the partition cannot be formed. In short, the cell region can also be formed by means of only one cell region 20. Further, the cell region 20 can also be formed while partitioned into five or more cell regions.

Figure 2:
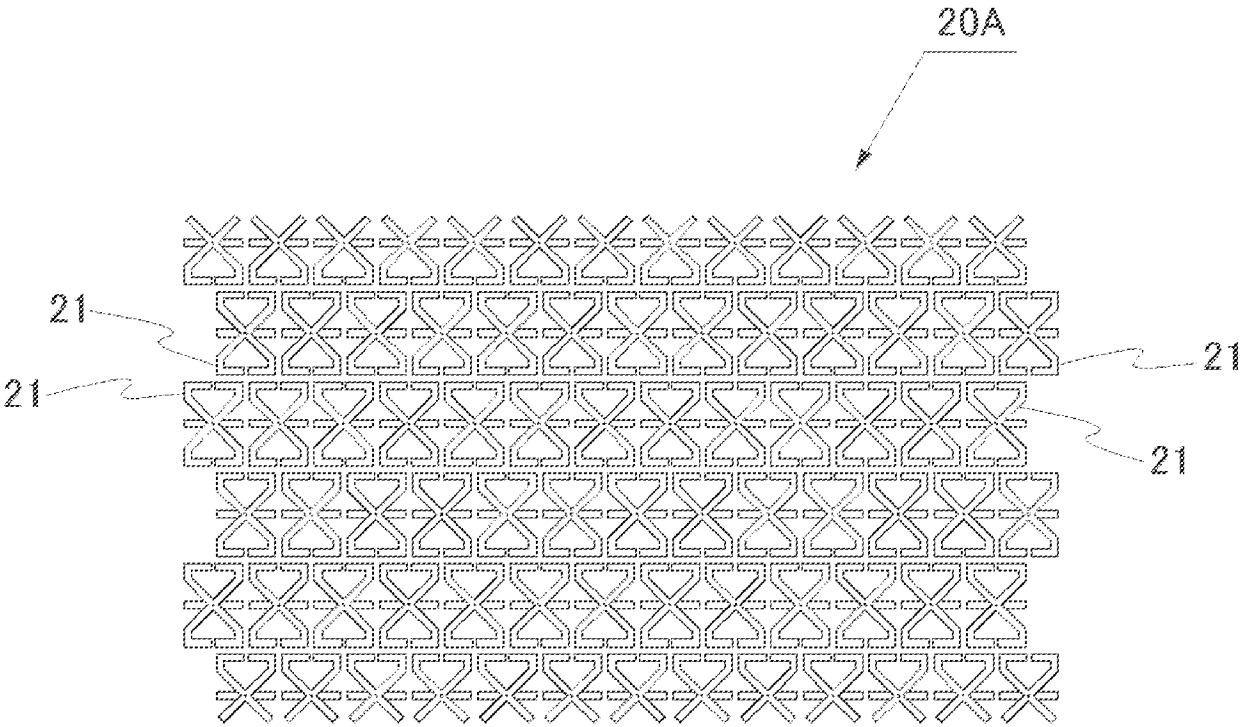
FIG. 2 is a drawing showing an example of a configuration of a cell region.

The cell regions 20A to 20D have each substantially an identical configuration, and a plurality of cells 21 are two-dimensionally arrayed lengthwise and crosswise in each of the cell regions. FIG. 2 illustrates an example of the cell region 20A, and the cell regions 20B to 20D each also assume a similar configuration. As illustrated, the cell 21 is two-dimensionally arrayed in numbers in the cell region 20A lengthwise and crosswise. Although the array of the cells 21 can be one-dimensional or three-dimensional, the cells 21 are presumed to be arrayed lengthwise and crosswise in a two-dimensional pattern in the embodiment.

Each of the cell regions 20 can be operated as a CRLH (Composite Right and Left Handed) structure. The CRLH structure is a Composite Right Handed and Left Handed structure, or a composite structure made up of a RH (right handed) structure in which a dielectric constant and magnetic permeability assume positive values and a LH (left handed) structure in which a dielectric constant and magnetic permeability assume negative values. In the right handed structure, behaviors that are found in a substance belonging to the natural world are exhibited. In contrast, in the left handed structure, behaviors that are not found in the natural world are exhibited. Specifically, the left handed structure is made up of an artificial substance. A left handed structure is also called a meta-material.

Each size of the cells 21 is considerably minute. The cell region 20 is provided in order to change a characteristic of the circuit section 5 (the isolation circuit) placed in the first layer. Although each size of the cells 21 is considerably minute, the cell is smaller than at least a wavelength 2 of a signal (a high frequency signal) being transmitted through the Merchand balun. In reality, the cell 21 is sufficiently smaller than the wavelength $\lambda$.

Figure 3:
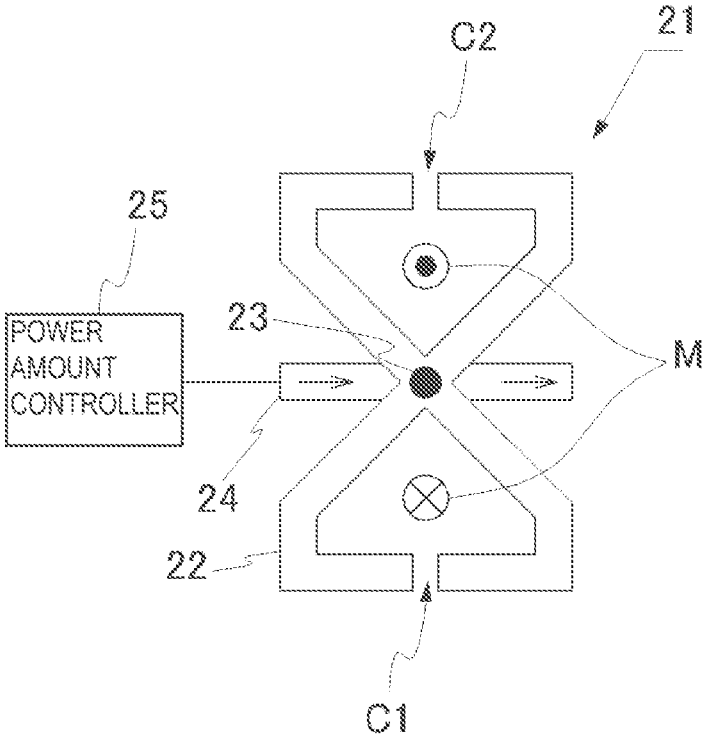
FIG. 3 is a drawing showing a cell configuration of the cell region.

FIG. 3 shows a configuration of one cell 21. As illustrated in the drawing, the cell 21 is made up of a first conductor 22, a second conductor 23, and a feed line 24. The first conductor 22 is a conductive substance to let a surface current flow. At least one capacitance is included in the first conductor 22. In order to satisfy the requirements, a substantially figure-eight geometry is adopted, and spacings (cuts of the first conductor 22) C1 and C2 are provided at two positions, an upper position and a lower position. The spacings C1 and C2 make up capacitance.

An arbitrary shape can be applied to the first conductor 22 so long as the first conductor 22 is the conductive substance containing at least one capacitance. Any shape can be adopted from; for instance, a substantially square shape, a substantially triangular shape, and a predetermined planar shape. In this respect, the first conductor should include at least one capacitance despite adoption of any shape. The location of the capacitance is not restricted so long as the capacitance is formed at any location of the first conductor 22. Lengths of respective sides of the cell (e.g., a vertical length and a horizontal length of a plane of the first conductor 22, a longitudinal length of the feed line 24 in one cell 21, and the like) can be mentioned as the size of the cell 21.

The second conductor 23 is formed as a via (a through hole) and extends in a direction orthogonal to a paper plane of FIG. 3. In FIG. 3, the second conductor 23 is placed at a point of intersection in the substantially figure-eight shape of the first conductor 22 but can also be provided at an arbitrary position of the first conductor 22. The second conductor 23 is short-circuited (short-stubbed) to an unillustrated common electric potential (e.g., a ground). The second conductor 23 thereby possesses inductance. A substance other than the via can be applied to the second conductor 23, so long as the substance is a conductor possessing inductance.

The feed line 24 is a current path along which an electric current flows. The feed line 24 is laid at a position that is different level from the first conductor 22, with respect to the direction perpendicular to the paper plane of FIG. 3. Therefore, the first conductor 22 becomes out of contact with the feed line 24. Further, the feed line 24 and the second conductor 23 are configured so as to become noncontact. Accordingly, at least a hole whose diameter is larger than a diameter of the second conductor 23 is opened in the feed line 24. The second conductor 23 is fitted into the hole without contacting the feed line 24.

A power amount controller 25 is connected to the feed line 24. The power amount controller 25 can operate as a current source that feeds electric power to the feed line 24, to thus let an electric current flow, simultaneously enabling appropriate control of an amount of electric power to be fed (an amount of electric current). FIG. 3 shows contact feeding in which electric power is fed by connecting the power amount controller 25 to the feed line 24. However, feeding can also be performed by means of noncontact feeding (e.g., wireless feeding).

The power amount controller 25 can individually feed electric power to the plurality of cells 21, or one power amount controller 25 can feed electric power to a predetermined number of cells 21 of the plurality of cells 21. For instance, the feed lines 24 of the plurality of cells 21 arrayed in one line are connected together, and electric power can be fed from the same power amount controller 25 to them. A feeding method is arbitrary. For instance, feeding can also be performed by means of radiation of an electromagnetic wave. Moreover, there can also be adopted a configuration in which all cells 21 of the cell region 20A are fed with electric power from a single power amount controller 25.

Accordingly, depending on a mode of feeding electric power to each of the cells 21, there may be a case where the power amount controllers 25 that are equal in number to the cells 21 are provided. Alternatively, there may also be a case where the power amount controllers 25 that are fewer in number than the cells 21 are provided. In other words, depending on the feeding mode, the number of power amount controllers 25 is at least one or more.

As a result of electric power being fed to the feed line 24, an electric current (a high frequency current or a low frequency current) flows. As shown in FIG. 3, a magnetic field M thereupon arises. As a result of development of the magnetic field M, a surface current flows into the first conductor 22. A magnitude of the surface current is proportional to an amount of electric power fed to the feed line 24 (i.e., an amount of electric current).

As a result of the surface current flowing into the first conductor 22, electric charges build up in the capacitances C1 and C2, and electric current flows into the second conductor 23. An LC resonance circuit that has a constant resonance frequency in accordance with the amount of electric power fed to the feed line 24 is thereby formed. Accordingly, one cell 21 makes up an LC resonance circuit, and the cells 21 are arrayed in numbers lengthwise and crosswise, whereby achieving a state in which a plurality of LC resonance circuits are arrayed.

In this regard, the cell 21 is placed in contiguity with another contiguous cell 21 in a noncontact manner. Stray capacitance thereby occurs among one cell 21 and surrounding contiguous cells 21. The stray capacitance also makes up capacitance of the LC resonance circuit. Since stray capacitance depends on the surface current of the first conductor 22, the stray capacitance is proportional to the amount of electric power fed through the feed line 24.

As shown in FIG. 2, the plurality of cells 21, each size of which is sufficiently minute when compared with the wavelength 2 of the signal, are two-dimensionally, contiguously arranged in a noncontact manner, whereby the cell region 20A having a constant area is formed. To be specific, the cell region 20A assumes a state in which a plurality of minute LC resonance circuits are placed in an array pattern. The structure can be caused to act as the CRLH structure.

The power amount controller 25 feeds electric power to the feed lines 24 of the respective cells 21 that make up the cell region 20A. Resonance is thereby induced in the LC resonance circuit, whereby a dielectric constant and magnetic permeability of the cell region 20A and a dielectric constant and magnetic permeability of its neighboring space are determined. The dielectric constant and the magnetic permeability are changed by changing the amount of electric power to be fed with the power amount controller 25. In other words, the dielectric constant and magnetic permeability of the cell region 20A and the dielectric constant and magnetic permeability of its neighboring space can be controlled by controlling the amount of electric power to be fed.

As mentioned above, the cell region 20A has a configuration in which the plurality of cells 21 are arrayed as an LC resonance circuit. In accordance with the amount of electric power to be fed, the dielectric constant and the magnetic permeability of the cell region 20A can be controlled. Accordingly, desired action, such as a change in amplitude, phase, and delay, can be given to a signal by controlling either or both the dielectric constant and/or the magnetic permeability.

As shown in FIG. 1, one or both a dielectric constant and/or magnetic permeability of neighboring spaces of the cell regions 20A to 20D of the second layer are controlled by the cell regions 20A to 20D. Although the dielectric constant is presumed to be controlled in the embodiment, magnetic permeability or both the dielectric constant and the magnetic permeability can be controlled. When dielectric constants of the cell regions 20A to 20D are controlled, a change occurs in dielectric constant of their neighboring space.

As shown in FIG. 1, the circuit section 5 is placed in the first layer board 3 of the first layer (Layer 1). Therefore, the circuit section 5 is situated at a location where the circuit section 5 experiences the action of the dielectric constant and magnetic permeability of the cell regions 20A to 20D (for instance, a location that is two-dimensionally or three-dimensionally near the cell regions 20A to 20D). The action affects the circuit section 5, whereby the characteristic of the circuit section 5 changes. In short, the characteristic of the Merchand balun changes.

However, a characteristic of the isolation circuit is uniquely determined by a physical circuit design, and a frequency and a phase characteristic of a signal employed fall within a predetermined range. Specifically, a characteristic of a normal isolation circuit is fixed. For example, when an isolation circuit with a 1 GHz band circuit design is used, a 2 GHz band signal cannot be used for the isolation circuit. Moreover, the same also applies to a phase characteristic. Furthermore, the isolation circuit also includes input and output impedance characteristics and a passage loss characteristic. These characteristics are also fixed by the design of the isolation circuit.

Accordingly, the characteristic of an ordinary isolation circuit is fixed by its circuit design. Accordingly, when an isolation circuit having a different characteristic is used, the isolation circuit needs to be replaced. In this regard, in the embodiment, the characteristic of the isolation circuit can be freely changed without replacing the isolation circuit 1. To this end, the cell region 20 and the circuit section 5 are stacked one on top of the other, and the dielectric constant and magnetic permeability of the cell region are controlled by feeding electric power to the cell region 20 with use of the power amount controller 25. As mentioned above, a signal passing through the isolation circuit 1 experiences a change in amplitude, phase, delay, impedance, a passage loss characteristic, or the like, by controlling the dielectric constant or the magnetic permeability. The characteristic of the isolation circuit 1 is thereby changed.

The circuit section 5 is a Merchand balun, and a single-phase signal (a single end signal) is input to the circuit section 5 by way of the input port 10. The single end signal is transmitted through the first line 11. As a result of the single end signal transmitted through the first line 11, a signal is transmitted through the second line 12, and a signal also is transmitted through the third line 13 and the fourth line 14 by means of action of electromagnetic coupling. Signals are transmitted through both the third line 13 and the fourth line 14 at this time, and these two signals are opposite in phase. The single end signal input by way of the input port 10 is thereby transformed into a differential signal and output from the first output port 17 and the second output port 19. The function of the Merchand balun is thus fulfilled.

The Merchand balun is an isolation circuit, and the characteristic of the isolation circuit 1 corresponds to the 1 GHz band signal but often fails to correspond to the 2 GHz band signal. In this case, the isolation circuit cannot output a 2 GHz band differential signal. For this reason, the power amount controller 25 controls the amount of electric power fed to the feed line 24.

The dielectric constant and magnetic permeability of each of the cell regions 20A to 20D and the dielectric constant and magnetic permeability of their neighboring space are thereby changed. The circuit section 5 experiences action of changes in dielectric constant and magnetic permeability, whereby the characteristic of the circuit section 5 (i.e., a passband characteristic of the signal) changes. The isolation circuit 1 thereby becomes able to transform a 2 GHz band single end signal into a differential signal. In short, the characteristic of the isolation circuit 1 itself can be changed by means of changing only the amount of electric power to be fed with the power amount controller 25. The characteristic of the isolation circuit 1; namely, the characteristic of the Merchand balun, can thereby be changed, so that a signal having a different frequency band can be transformed from a single end signal into a differential signal.

By means of changing the amount of electric power to be fed with the power amount controller 25, either or both the dielectric constant and/or the magnetic permeability of each of the cell regions 20A to 20D and their neighboring space can be controlled. With this, it becomes possible to make an available frequency band variable and also control various characteristics, like a phase characteristic and a loss characteristic of a signal which would arise during passage of a signal through an isolation circuit, input and output impedance characteristics, a signal attenuation characteristic, and the like.

For instance, a designed isolation circuit causes considerable amounts of mismatch in input and output impedance characteristics. However, the input and output impedance characteristics can be controlled by changing the amount of electric power to be fed with the power amount controller 25. The amount of electric power to be fed can thereby be optimally controlled, so that perfect impedance matching can be attained in connection with the input and output impedance characteristics, to thus eliminate signal reflections.

In the above, the cell region 20 is divided into the four cell regions 20A to 20D, and they are isolated from each other. However, a division number can be arbitrarily set. Since the cell regions 20A to 20D are provided in correspondence to the first line 11 to the fourth line 14, respectively, the division number is set to four. Therefore, the characteristic of the first line 11 is controlled by the cell region 20A; the characteristic of the second line 12 is controlled by the cell region 20B; the characteristic of the third line 13 is controlled by the cell region 20C; and the characteristic of the fourth line 14 is controlled by the cell region 20D.

The division number of the cell region 20 can be arbitrarily set as above, and each of the divided cell regions is controlled by means of a different dielectric constant and different magnetic permeability. For instance, control can be performed such that one-half of the first line 11 and the remaining of the same assume different characteristics, respectively. Further, the way to divide the cell region 20 is not limited to the cross shape but may also be divided in an oblique direction. However, the minimum requirement for this case is to assure isolation of divided cell regions. The characteristic can be changed at any locations in the circuit section 5 by increasing the division number of the cell region 20. To be specific, the larger the division number, the greater the accuracy of adjustment of characteristic parameters of the circuit section 5.

Figures 4A, 4B:
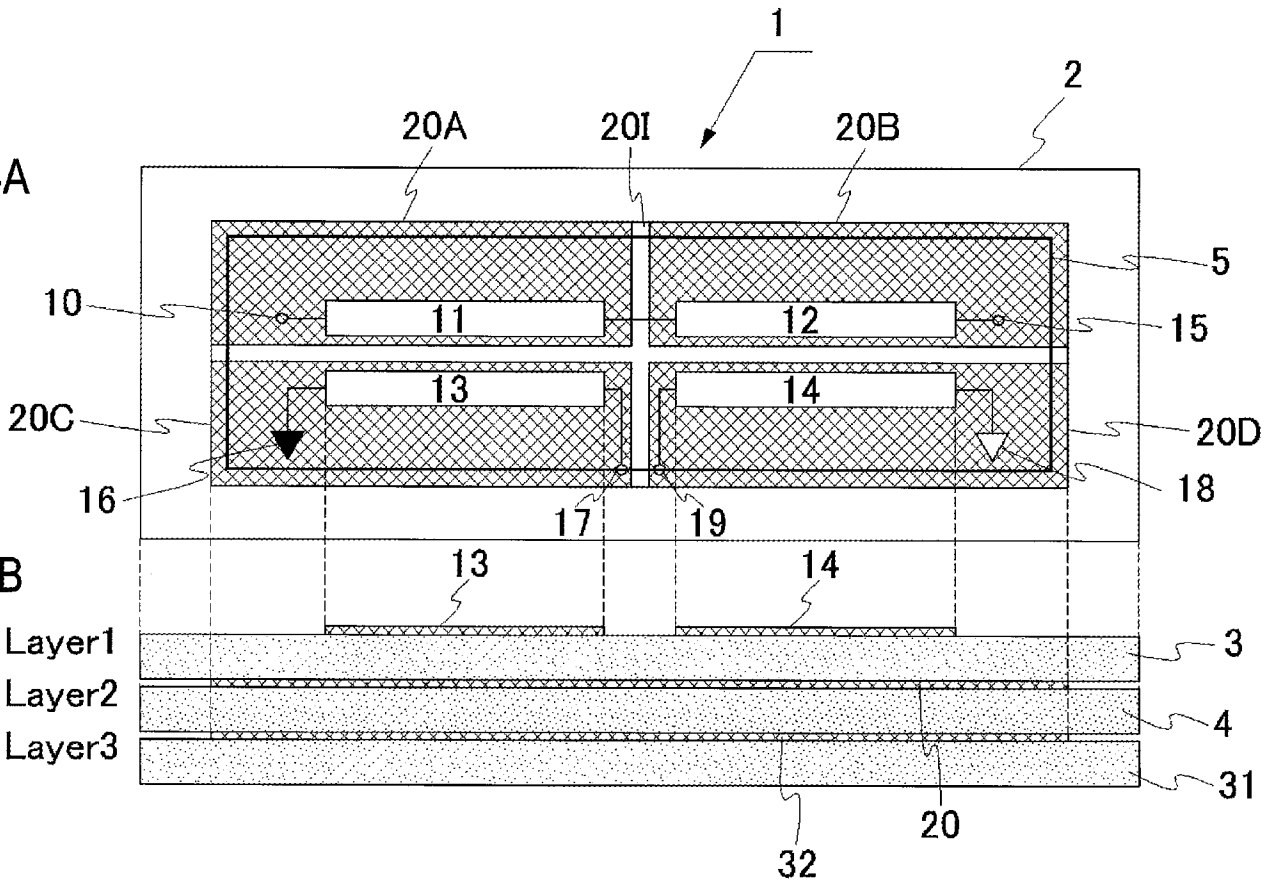
FIGS. 4A and 4B are top and side views, respectively, of the isolation circuit of FIG. 1 over which a shielding region is laid.

A first modification is now described by reference to FIGS. 4A and 4B. The isolation circuit 1 of the first modification assumes at least a three-layered structure. Specifically, in the first layer, a Merchand balun circuit is laid on the first layer board 3. In the second layer, the cell region 20 is laid on the second layer board 4. In a third layer (Layer 3), a shielding region 32 is laid on a third layer board 31. The shielding region 32 adopts the same configuration as that of the cell region 20 in such a manner that a plurality of cells 21 are arrayed lengthwise and crosswise, whereby a plurality of LC resonance circuits are arrayed. However, the shielding region 32 is not isolated and divided into sub-regions.

Therefore, in the shielding region 32, the plurality of cells 21 are arrayed and the amount of electric power fed to the respective cells 21 can be freely controlled. This makes it possible to freely control a dielectric constant and magnetic permeability. The shielding region 32 is provided in order to prevent intrusion of external noise. When external noise intrudes into the isolation circuit, a signal that passes through the isolation circuit 1 will be affected by the noise.

A refractive index of the shielding region 32 is changed by controlling a dielectric constant and magnetic permeability of the shielding region 32 and its neighbors, whereby external noise can be reflected. Accordingly, an unillustrated power amount controller controls the amount of electric power fed to the respective cells 21 such that a dielectric constant and magnetic permeability that reflect external noise are acquired. As a result, intrusion of noise which would affect the purity of a signal in the circuit section 5 can be prevented.

Figures 5A, 5B:
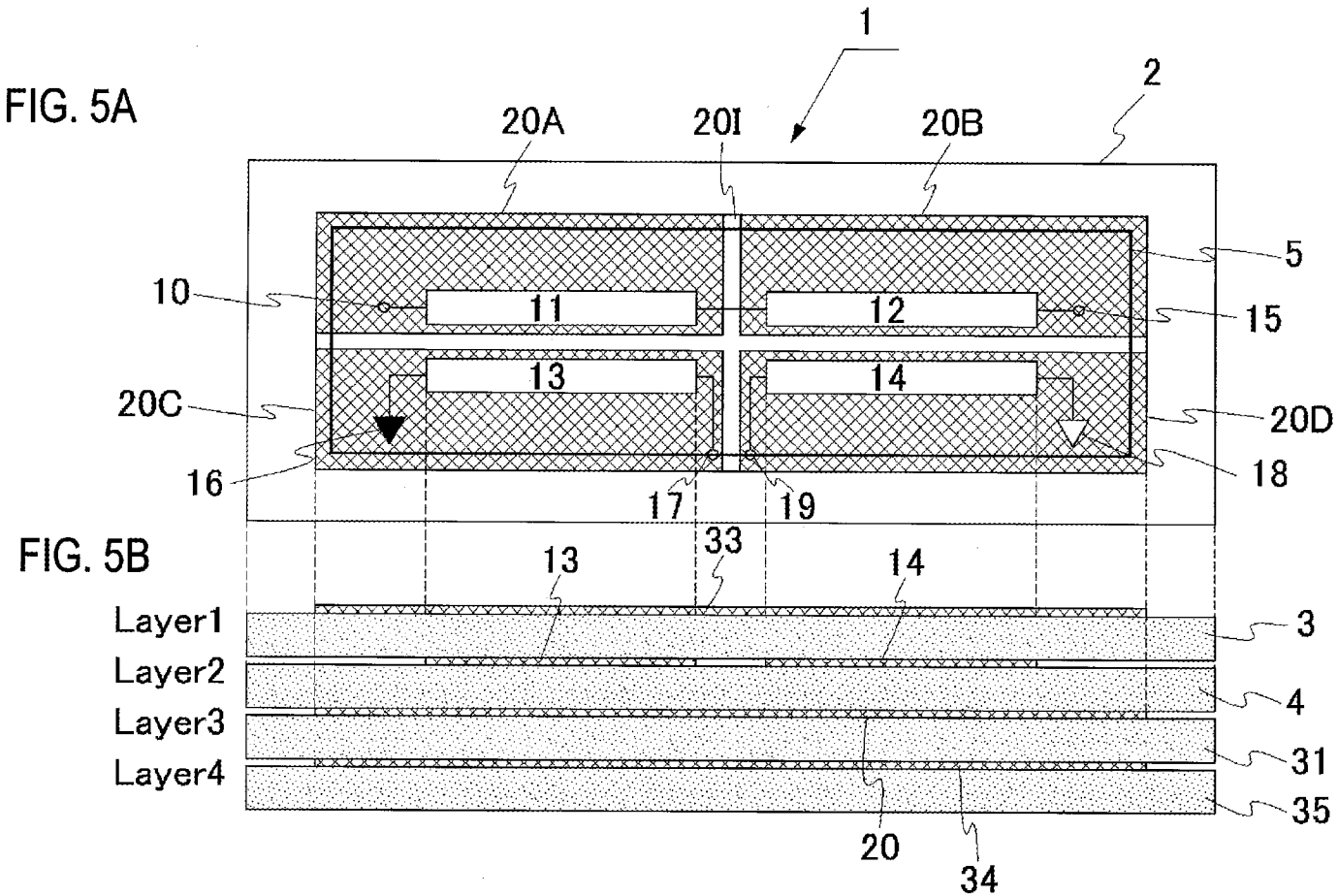
FIGS. 5A and 5B are top and side views, respectively, of the isolation circuit of FIG. 1 that is given a four-layer structure.

FIGS. 5A and 5B show a second modification. FIG. 5 shows a four-layered structure. An upper layer shield 33 is laid on the first layer board 3 of the first layer, and the circuit section 5 is laid on the second layer board 4 of the second layer. The cell region 20 is laid on the third layer board 31 of the third layer, and a lower layer shield 34 is laid on a fourth layer board 35 of a fourth layer (Layer 4). In the second modification, the circuit section 5 is situated in the layered structure. In the layered structure, the circuit section 5 and the cell region 20 are sandwiched between the upper layer shield 33 and the lower layer shield 34. Although the layered structure shown in FIG. 5 is a four-layered structure, the layered structure can also include a much larger number of layers. A layered structure including five layers or more can also be likewise employed for the embodiment and the modification that are shown in FIG. 1 and FIG. 4.

As above, the cell region 20 changes the characteristic of the circuit section 5. Likewise the cell region 20, the upper layer shield 33 (an upper shield layer) and the lower layer shield 34 (a lower shield layer) each has a structure in which a plurality of LC resonance circuits are arrayed, by arraying a plurality of cells 21 lengthwise and crosswise. In this regard, the upper layer shield 33 and the lower layer shield 34 are not isolated from each other, and the shields are not divided.

The power amount controller 25 controls the amount of electric power fed to each of the cells 21 of the cell region 20. The characteristic of the circuit section 5 is thereby changed. Even the upper layer shield 33 and the lower layer shield 34 control the amount of electric power fed to the plurality of cells 21 by means of an unillustrated power amount controller. The upper layer shield 33 and the lower layer shield 34 can thereby provided with a characteristic that reflects external noise. To be specific, the upper layer shield 33 and the lower layer shield 34 each have a characteristic that is similar to that of the shielding region 32.

Intrusion of external noise into the circuit section 5 sandwiched between the upper layer shield 33 and the lower layer shield 34 is thereby blocked, so that the signal of the circuit section 5 is prevented from being affected by noise. The shielding region 32 shown in FIG. 4 can protect the circuit section 5 from noise originating from one direction, but the circuit section 5 cannot be protected from noise originating from an opposite direction.

Accordingly, the circuit section 5 can be protected from noise originating from two directions by sandwiching the circuit section 5 between the upper layer shield 33 and the lower layer shield 34. The amount of electric power fed to each of the cells 21 of the upper layer shield 33 and the lower layer shield 34 is controlled such that external noise is reflected, thereby enabling substantially perfect protection of a signal of the circuit section 5.

A third modification is now described by reference to FIG. 6. In the third modification, a characteristic of the isolation circuit 1 can be automatically, optimally adjusted. A characteristic adjustment system 40 of the isolation circuit is illustrated in the drawing. The characteristic adjustment system 40 of the isolation circuit is equipped with the isolation circuit 1, an input terminal 41, an attenuator 42, an output terminal 43, a signal detector 44, a characteristic controller 45, and a power amount controller 46. The characteristic controller 45 is further equipped with an adjustment level calculator 47, a power amount calculator 48, and an attenuator controller 49.

Any of the isolation circuit 1 shown in FIG. 1, the isolation circuit 1 shown in FIG. 4, and the isolation circuit 1 shown in FIG. 5 can be applied to the isolation circuit 1. However, the amount of electric power to be fed to the cell regions 20A to 20D is controlled in order to vary the characteristic of the circuit section 5. A signal S is input by way of the input terminal 41. The attenuator 42 is a variable attenuator, and the signal S is attenuated by the attenuator 42 by a predetermined amount. The signal S is input to the isolation circuit 1.

The signal S output from the isolation circuit 1 is output from the output terminal 43. The signal S is also input to the signal detector 44. The signal detector 44 detects a level of the signal S (an amplitude, power, and the like, of the signal). Herein, the level of the signal S is the detection result of the signal detector 44. The detected signal level is input to the adjustment level calculator 47 of the characteristic controller 45. The adjustment level calculator 47 recognizes the detected signal level.

The signal level of the signal S output from the output terminal 43 must be controlled to a predetermined signal level. For instance, if the signal S undergoes reflection as a result of a mismatch in input-output impedance being caused by the isolation circuit 1, a loss will occur in the signal level. Accordingly, the adjustment level calculator 47 outputs a signal indicating this influence to the power amount calculator 48. The power amount calculator 48 calculates a value of an amount of electric power to be fed that matches the input-output impedance of the isolation circuit 1. In this respect, however, if the signal level of the signal S is not so high, the amount of attenuation performed by the attenuator 42 does not need to be changed.

The calculated amount of electric power to be fed is output to the power amount controller 46, and the power amount controller 46 feeds an electric power to the feed line 24 of the isolation circuit 1. The dielectric constants of the cell regions 20A to 20D and their neighboring space are thereby also changed, so that impedance matching can be fulfilled. Accordingly, the signal level of the signal S output from the isolation circuit 1 will not be attenuated and become high. The input-output impedance of the isolation circuit 1 thereby comes to a desired impedance level, so that the output terminal 43 can output the signal S having an intended signal level.

In the meantime, there is a case where the signal level of the signal S input by way of the input terminal 41 is excessively high. In this case, the signal detector 44 detects the high signal level. The amount of electric power fed to the cells 21 of the respective cell regions 20A to 20D are controlled, which also makes it possible to decrease the signal level. However, since the attenuator 42 can cause a greater decrease in signal level than does the isolation circuit 1, the attenuator 42 is used when a large amount of decrease in signal level is required.

For these reasons, when the amount of a decrease in signal level of the signal S is large, the adjustment level calculator 47 notifies the attenuator controller 49 of the amount of decrease in signal level (i.e., an amount of attenuation). The attenuator controller 49 controls the attenuator 42 by reference to the notification. Accordingly, the attenuator 42 attenuates the signal S by means of a predetermined amount of attenuation. The thus-attenuated signal S is input to the isolation circuit 1.

After the attenuator 42 has performed a great amount of attenuation, the adjustment level calculator 47 recognizes the amount of attenuation by means of which the signal S is subjected to additional attenuation. The cell regions 20A to 20D of the isolation circuit 1 perform attenuation. The power amount calculator 48 calculates a value of the amount of electric power to be fed which would be required to perform attenuation, and the power amount controller 46 feeds an electric power to each of the cells 21. The output terminal 43 can thereby output the signal S with a desired signal level.

Although the amount of electric power fed to the cells 21 of the respective cell regions 20A to 20D of the isolation circuit 1 can be controlled, the attenuator 42 can provide a greater amount of attenuation when performing attenuation. Accordingly, the attenuator 42 attenuates the signal level much, and the isolation circuit 1 adjusts the signal level minutely, whereby the signal level of the signal S can be controlled to a desirable level.

The characteristic controller 45 can be implemented by; for instance, an unillustrated external computer. Specifically, a value detected by the signal detector 44 is automatically or manually captured in a computer, and the computer calculates a value of the amount of electric power to be fed or a value of the amount of attenuation to be performed by the attenuator 42 from the detected value. The calculated value is automatically or manually given to the power amount controller 46 or the attenuator 42 from the computer.

Accordingly, the amount of electric power fed to the cells 21 of the respective cell regions 20A to 20D is controlled, thereby making it possible to change the characteristic of the isolation circuit 1 in a various manner. For instance, the isolation circuit can employ a signal at an arbitrary frequency band, freely control input-output impedance, and control the amount of attenuation. Moreover, as shown in FIG. 6, the signal detector 44 detects the signal S, and the characteristic controller 45 controls the amount of electric power to be fed with the power amount controller 46, whereby a desirable characteristic of the isolation circuit 1 can be automatically acquired.

Figure 6:
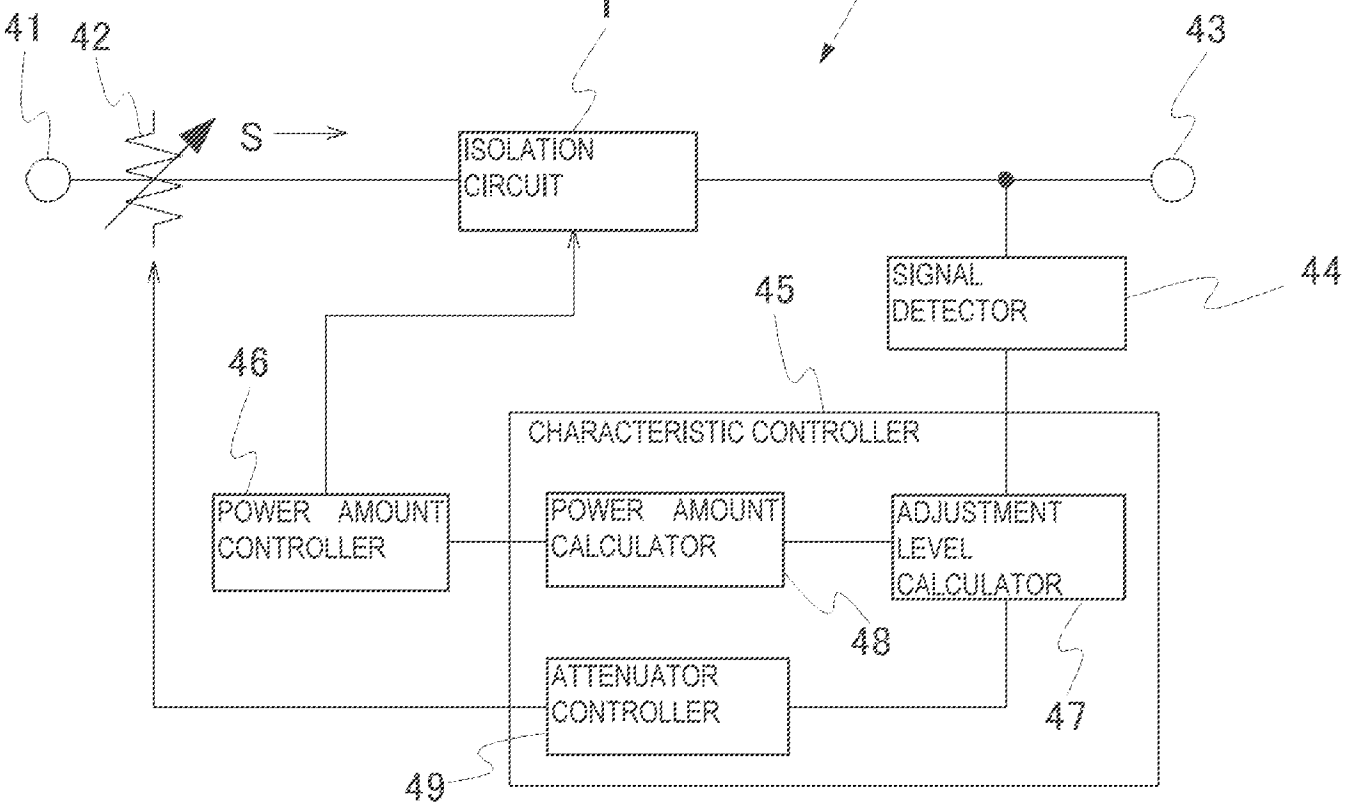
FIG. 6 is a block diagram showing a configuration of a characteristic adjustment system of the isolation circuit.

Incidentally, a desirable (optimal) characteristic of the isolation circuit 1 can be automatically acquired in FIG. 6, but the characteristic adjustment system 40 of the isolation circuit 1 is required. In this respect, so long as the desirable characteristic of the isolation circuit 1 can be previously recognized, there is no necessity for use of the characteristic adjustment system 40 of the isolation circuit 1. For instance, when a 2 GHz band signal is used, a corresponding amount of electric power to be fed is set on the power amount controller 25 in FIG. 3, so that the characteristic of the isolation circuit 1 conforming to an objective can be obtained.

Specifically, a desirable characteristic can also be set for the isolation circuit 1 in advance rather than the characteristic of the isolation circuit 1 being automatically adjusted. For instance, when a 1 GHz band signal is next used, the amount of electric power to be fed commensurate with the 1 GHz band is set on the power amount controller 25 shown in FIG. 3, whereby the isolation circuit 1 conforming to the 1 GHz band can be used. Even when an isolation circuit for use at a 1 GHz band and an isolation circuit for use at a 2 GHz band are separately designed, design work can be readily performed by means of changing only the amount of electric power to be set on each of the power amount controllers 25.

A fourth modification is now described by reference to FIG. 7. The fourth modification is an example of a shielding device 50 of an isolation circuit intended to protect the isolation circuit 1. As illustrated in the drawing, the isolation circuit 1 is sandwiched between a first shield 51 and a second shield 52. Noise N is present in an environment of the isolation circuit 1, and the noise N affects the signal of the isolation circuit 1.

The first shield 51 and the second shield 52 reflect noise N. In the first shield 51 and the second shield 52, a plurality of cells 21 are arrayed lengthwise and crosswise, as in the case of the cell region 20 shown in FIG. 1. Isolation of the shields is not required. Accordingly, the amount of electric power to be fed with a power amount controller 25 is controlled, whereby a characteristic of the first shield 51 and a characteristic of the second shield 52 can be adjusted.

Characteristic adjustment is fulfilled by the following operation. Noise N is input to an antenna 61 of a shield controller 53. The noise N input to the antenna 61 is subjected to frequency analysis by a frequency analyzer 62. If the noise N does not affect the signal of the isolation circuit 1, particular operation does not need to be performed. Specifically, the first shield 51 and the second shield 52 can also be set so as to allow passage of the noise N.

In the meantime, when an analysis performed by the frequency analyzer 62 shows that the noise N has a frequency which will affect the signal of the isolation circuit 1, a level detector 63 detects a level of the noise N detected by the antenna 61. A power amount calculator 64 controls a refractive index of the first shield 51 and a refractive index of the second shield 52, whereby a value of the amount of electric power to be fed that can sufficiently block the noise N by reflection is calculated. The calculated amount of electric power to be fed is output to a power amount controller 65.

The power amount controller 65 feeds the calculated amount of electric power to the cells 21 of the respective shields 51 and 52. The dielectric constant of the first shield 51 and the dielectric constant of the second shield 52 are thereby controlled, so that the refractive indices are changed to reflect the noise N. Thereby, influence on the signal of the isolation circuit 1 that passes between the first shield 51 and the second shield 52, which would otherwise be inflicted by the noise N, is prevented.

Incidentally, the shielding device 50 of the isolation circuit shown in FIG. 7 and the upper layer shield 33 and the lower layer shield 34 described in connection with FIG. 5 have the same function. In short, the isolation circuit 1 sandwiched between the upper layer shield 33 (the first shield 51) and the lower layer shield 34 (the second shield 52) is protected from the noise N. In this sense, the shielding device 50 has the same function as those of the upper layer shield 33 and the lower layer shield 34.

Figure 7:
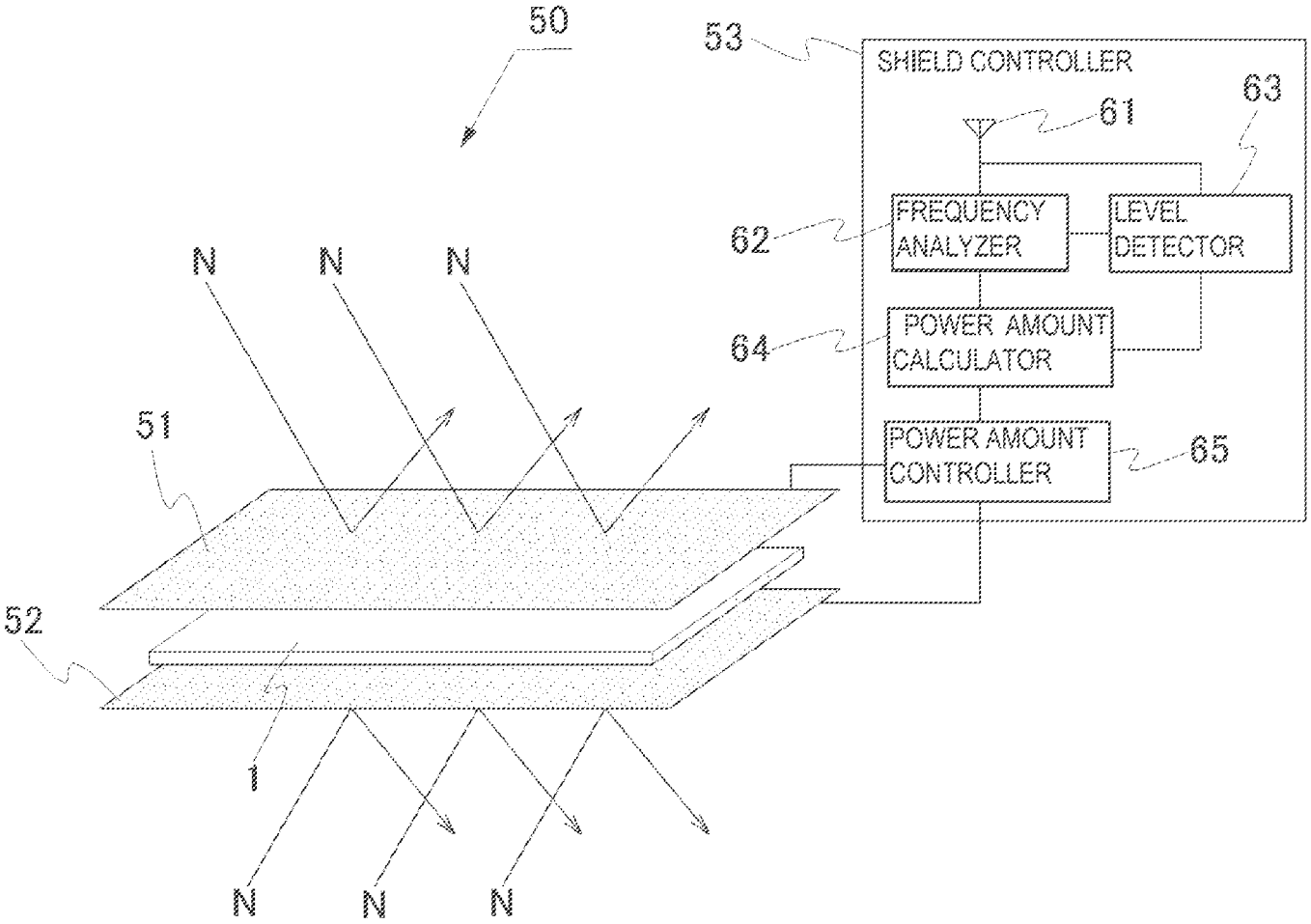
FIG. 7 is a block diagram showing a configuration of a shielding device of the isolation circuit.

Accordingly, the shield controller 53 shown in FIG. 7 can be connected to the upper layer shield 33 and the lower layer shield 34 shown in FIG. 5. Even in this sense, an optimal shielding effect for automatically protecting the isolation circuit 1 can be applied.

Figure 8:
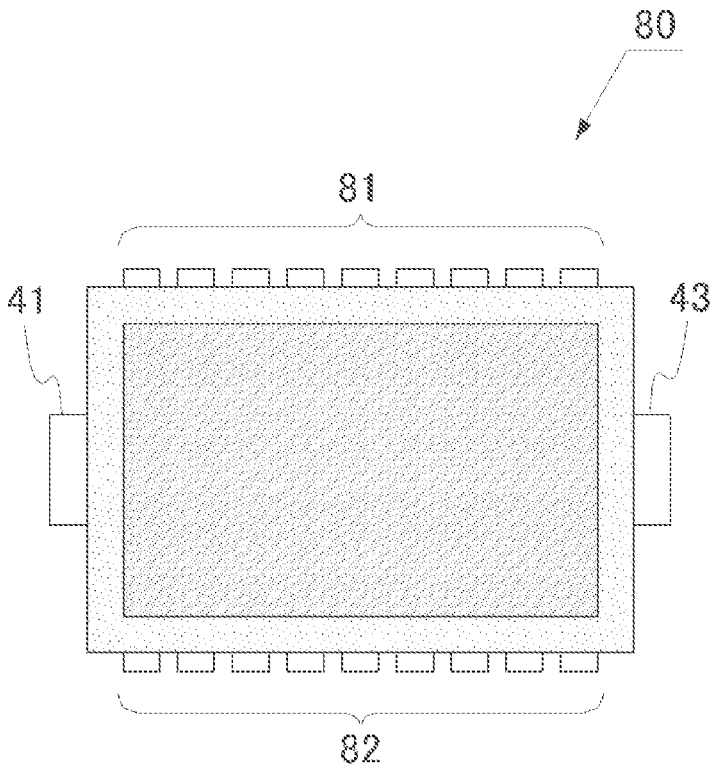
FIG. 8 is a drawing for explaining an example of a single chip into which any of the circuits is packaged.
Figure 9:
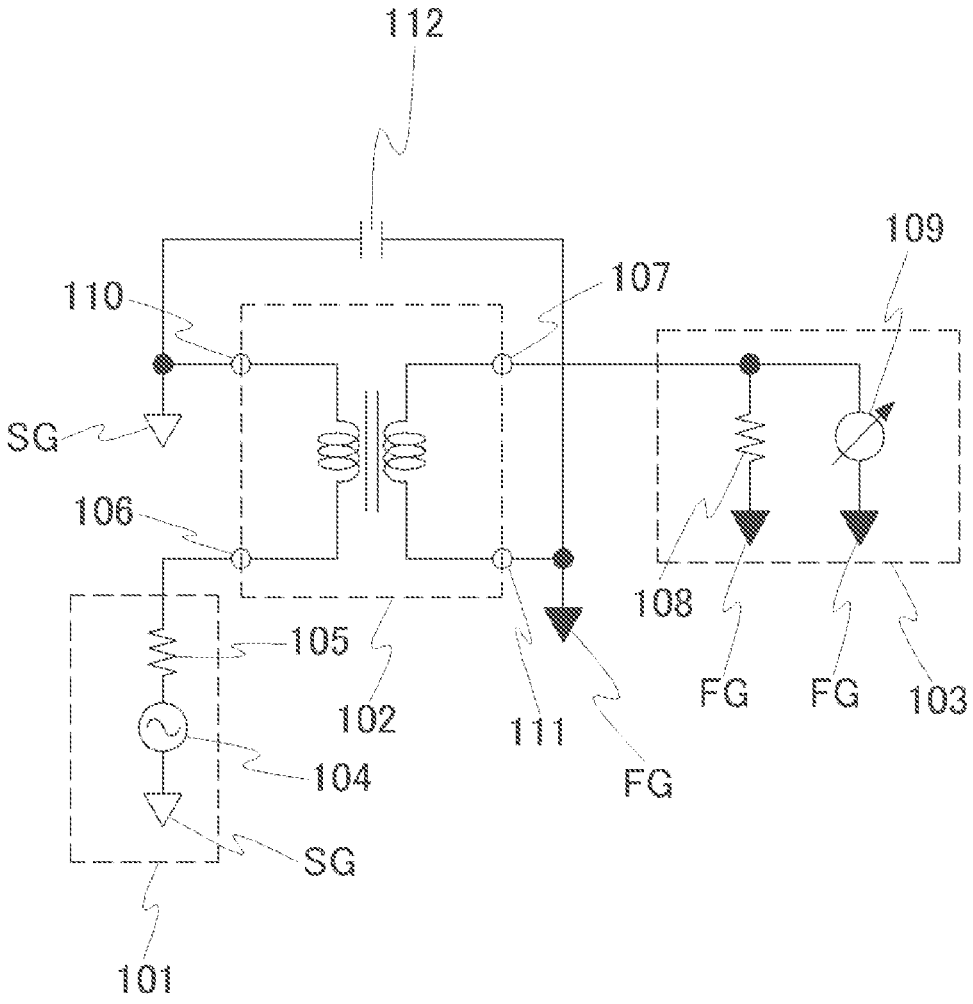
FIG. 9 is a diagram showing a circuit that is an equivalent of a related-art isolation circuit.

Next, by reference to FIG. 8, a fifth modification is described. The isolation circuit 1, the characteristic adjustment system 40 of the isolation circuit, and the shielding device 50 of the isolation circuit can be packaged into a single chip by use of a board that has a comparatively large dielectric constant. Using the board having a large dielectric constant enables miniaturization of a packaged single chip. All of the isolation circuit 1 and the characteristic adjustment system 40 of the isolation circuit can also be packaged into a single chip, or a part of them can be packaged into a single chip.

A chip 80 shown in FIG. 8 is an example of the chip 80 that is embodied as a result of the characteristic adjustment system 40 of the isolation circuit being packaged into a single chip. In addition to having the input terminal 41 and the output terminal 43, the chip 80 is equipped with a first control port 81 and a second control port 82. The signal S is input by way of the input terminal 41, and the signal S is output from the output terminal 43. The signal S passes through the isolation circuit 1 and can be output from the output terminal 43.

As mentioned above, there is provided the power amount controller 46 that is intended for controlling an amount of electric power to be fed to the feed lines 24 of the respective cells 21. The power amount controller 25 is a current source for feeding an electric current and embodied by ports (power feed ports) that are provided on the first control port 81 and the second control port 82.

When the chip 80 includes a CPU, an ALC (Automatic Level Control), a variable attenuator, a VCO (Voltage Controlled Oscillator), a PLL (Phase Locked Loop), a power divider/combiner (Power Divider/Combiner), an antenna, and the like, a port for controlling these elements is provided in the first control port 81 or the second control port 82.

The above explanation has indicated merely the specific preferable embodiment as the purpose of explanation and indication of the invention. Therefore, the invention should not be limited to the above embodiment, and can includes various changes or modifications can be made without departing from the spirit and scope of the invention.

The present application is based on Japanese patent application (patent application No. 2012-132443) filed on Jun. 12, 2012, and the contents of the patent application are hereby incorporated by reference.

DESCRIPTION OF REFERENCE NUMERALS

1 isolation circuit
2 layered body
5 circuit section
10 input port
11 first line
12 second line
13 third line
14 fourth line
20 cell region
20I isolation
21 cell
22 conductor
23 via
24 feed line
25 power amount controller
32 shielding region
33 upper layer shield
34 lower layer shield
40 characteristic adjustment system of isolation circuit
44 signal detector
45 characteristic controller
46 power amount controller
47 adjustment level calculator
48 power amount calculator
50 shielding device of isolation circuit
51 first shield
52 second shield
53 shield controller
65 power amount controller
80 chip

What is claimed is:

1. An isolation circuit comprising:

a cell region including a plurality of arrayed cells, each of which has a first conductor that has at least one capacitance, a second conductor that is connected to the first conductor, has an inductance, and is short-circuited to a common electric potential, and a feed line that is placed without a connection with the first conductor and the second conductor, each size of which is smaller than a wavelength of a signal which is subject to operation of the cells;

at least one power amount controller that controls an amount of electric power to be fed to each of the feed lines of the respective cells of the cell region, thereby controlling either or both a dielectric constant and/or magnetic permeability of the cell region; and a circuit section that is placed at a location where the circuit section undergoes action of either or both the dielectric constant and/or the magnetic permeability and that electrically isolates an input side from an output side.

2. The isolation circuit according to claim 1, wherein the power amount controller changes a characteristic of the circuit section by changing the amount of electric power to be fed.

3. The isolation circuit according to claim 1, wherein the amount of electric power to be fed is previously set in the power amount controller such that the circuit section assumes a desirable characteristic.

4. The isolation circuit according to claim 1, wherein the cell region is divided into a plurality of areas, and the power amount controller controls the amount of electric power to be fed for each of the areas.

5. The isolation circuit according to claim 1, wherein the first conductor has a substantially figure-eight shape including at least a cut formed in the substantially figure-eight shape.

6. The isolation circuit according to claim 1, further comprising:

a circuit layer on which the circuit section is placed;

a cell region layer on which the cell region is placed; and a shielding layer which is provided at a layer differing from the circuit layer and the cell region layer and reflects external noise, the shielding layer having the cell region and the power amount controller.

7. A characteristic adjustment system of an isolation circuit comprising:

the isolation circuit defined in claim 1;

a signal detector that detects a signal output from the isolation circuit; and a power amount calculator that calculates, from a detection result of the signal detector, a value of the amount of electric power to be fed that provides the isolation circuit with a desirable characteristic in order to provide the power amount controller with the value of the amount of electric power to be fed.

8. A shielding device of an isolation circuit comprising:

the isolation circuit defined in claim 1;

a first shield that is placed outside the isolation circuit, that has the cell region and the power amount controller, and that reflects external noise; and a second shield that is placed outside the isolation circuit, that has the cell region and the power amount controller, and that reflects the noise, wherein the isolation circuit is sandwiched between the first shield and the second shield.

9. A single chip formed by packaging the isolation circuit defined in claim 1.

10. A method for adjusting a characteristic of an isolation circuit comprising:

detecting a signal output from the isolation circuit defined in claim 1;

calculating, from a result of the detected signal, a value of the amount of electric power to be fed that provides the isolation circuit with a desirable characteristic in order to provide the power amount controller of the isolation circuit with the value of the amount of electric power to be fed; and feeding an electric power of the calculated value to the feed line of the isolation circuit with use of the power amount controller.

* * * * *